US008967682B2

(12) United States Patent
Jankowski et al.

(10) Patent No.: US 8,967,682 B2
(45) Date of Patent: Mar. 3, 2015

(54) VEHICLE DOOR LATCH WITH MOTION RESTRICTION DEVICE PROHIBITING RAPID MOVEMENT OF OPENING LEVER

(75) Inventors: Krystof Peter Jankowski, Waterford, MI (US); Ehab Kamal, Novi, MI (US); Lynn DaDeppo, Bloomfield Hills, MI (US)

(73) Assignee: Magna Closures Inc., Newmarket, Ontario (CA)

( * ) Notice: Subject to any disclaimer, the term of this patent is extended or adjusted under 35 U.S.C. 154(b) by 166 days.

(21) Appl. No.: 12/556,122

(22) Filed: Sep. 9, 2009
(Under 37 CFR 1.47)

(65) Prior Publication Data

US 2010/0320777 A1 Dec. 23, 2010

Related U.S. Application Data

(63) Continuation-in-part of application No. 12/190,707, filed on Aug. 13, 2008, now Pat. No. 8,196,975.

(60) Provisional application No. 60/964,611, filed on Aug. 14, 2007.

(51) Int. Cl.
*E05C 3/16* (2006.01)
*E05B 85/24* (2014.01)
(Continued)

(52) U.S. Cl.
CPC ..... *E05B 85/243* (2013.01); *E05B 77/06* (2013.01); *E05B 77/12* (2013.01); *E05B 77/42* (2013.01); *E05B 85/16* (2013.01); *E05B 85/26* (2013.01); *Y10S 292/23* (2013.01); *Y10S 292/22* (2013.01)
USPC ..... 292/216; 292/201; 292/DIG. 23; 292/DIG. 22

(58) Field of Classification Search
CPC ..... E05B 77/42; E05B 77/06; E05B 77/04; E05B 77/54
USPC ..... 292/201, 216, DIG. 23, DIG. 62, 292/DIG. 56, DIG. 22
See application file for complete search history.

(56) References Cited

U.S. PATENT DOCUMENTS 4,503,170 A 3/1985 Drake et al.
4,503,952 A * 3/1985 Hesse ..... 188/306
(Continued)

FOREIGN PATENT DOCUMENTS

DE 4318544 C1 5/1994
DE 102007007941 A1 8/2008
(Continued)

OTHER PUBLICATIONS

Eric D. Wetzel, et al, "The Effect of Rheological Parameters on the Ballistic Properties of Shear Thickening Fluid (STF)-Kevlar Composites" Numiform 2004. Jun. 13-17, 2004. Columbus, OH p. 1-6.
(Continued)

*Primary Examiner* — Kristina Fulton
*Assistant Examiner* — Christine M Mills
(74) *Attorney, Agent, or Firm* — Miller Canfield

(57) ABSTRACT

In a vehicle door latch, a motion restriction device is coupled to an auxiliary pawl that is connected to the pawl of a ratchet and pawl combination. The auxiliary pawl must be actuated by one or more release levers in order to actuate the pawl and release the ratchet from a striker-containing position and open the latch. Because the only criterion for selectively prohibiting movement of the auxiliary pawl is its speed, it is possible to prevent the latch from unintentionally opening in a crash situation regardless of the direction the inertial forces of the crash are applied to the latch or the release levers therein or the outside or inside handles.

8 Claims, 6 Drawing Sheets

(51) Int. Cl.

| | |
|---|---|
| ***E05B 77/06*** | (2014.01) |
| ***E05B 77/12*** | (2014.01) |
| ***E05B 77/42*** | (2014.01) |
| *E05B 85/16* | (2014.01) |
| *E05B 85/26* | (2014.01) |

(56) References Cited

U.S. PATENT DOCUMENTS

| | | | | |
|---|---|---|---|---|
| 4,542,791 | A | 9/1985 | Drake et al. | |
| 4,982,782 | A | 1/1991 | Albers et al. | |
| 4,982,792 | A | 1/1991 | Hunt, III et al. | |
| 5,645,138 | A | 7/1997 | Tajima et al. | |
| RE36,694 | E * | 5/2000 | McFarland | 292/336.3 |
| 6,655,743 | B1 | 12/2003 | Parizat et al. | |
| 6,712,409 | B2 | 3/2004 | Monig | |
| 6,946,138 | B2 | 9/2005 | Iwai et al. | |
| 7,226,878 | B2 | 6/2007 | Wagner et al. | |
| 7,264,283 | B2 * | 9/2007 | Stoof et al. | 292/216 |
| 7,342,049 | B2 * | 3/2008 | Minemura et al. | 516/34 |
| 2001/0037702 | A1 * | 11/2001 | McFarland et al. | 74/573 F |
| 2002/0148075 | A1 | 10/2002 | Monig | |
| 2002/0171067 | A1 | 11/2002 | Jolly et al. | |
| 2004/0173422 | A1 | 9/2004 | Deshukh et al. | |
| 2005/0037189 | A1 | 2/2005 | Palmer et al. | |
| 2005/0121920 | A1 * | 6/2005 | Machida | 292/201 |
| 2006/0234577 | A1 | 10/2006 | Wagner et al. | |
| 2006/0261603 | A1 * | 11/2006 | Cetnar et al. | 292/216 |
| 2007/0200357 | A1 | 8/2007 | Westerwick et al. | |

FOREIGN PATENT DOCUMENTS

| | | | |
|---|---|---|---|
| FR | 2897381 | A1 | 8/2007 |
| JP | H09317289 | A | 12/1997 |

OTHER PUBLICATIONS

Young S. Lee, et al "The ballistic impact characteristics of Kevlar R woven fabrics impregnated with a colloidal shear thickening fluid" Journal of Materials Science 38 (2003) p. 2825-2833.

* cited by examiner

VEHICLE DOOR LATCH WITH MOTION RESTRICTION DEVICE PROHIBITING RAPID MOVEMENT OF OPENING LEVER

CROSS-REFERENCE TO RELATED APPLICATIONS

This is a continuation-in-part of U.S. patent application Ser. No. 12/190,707 filed Aug. 13, 2008, the contents of which are incorporated herein by reference in their entirety.

FIELD OF THE INVENTION

The invention relates to the use of a motion restriction device for prohibiting the rapid movement of an opening lever in a vehicle door latch, and more particularly for selectively preventing rapid movement of an auxiliary latch pawl in a crash situation but not in a door slam situation.

BACKGROUND OF THE INVENTION

It is possible in a vehicle crash situation that the impact resulting from the crash could have a deleterious effect on any part of the vehicle door latch system, which is intended to keep the vehicle door latched to the vehicle body. However, in a crash, particularly in a roll-over situation where the door latch may be subjected to inertial forces directed over a wide angular range in three dimensions, the forces acting on the latch system may unintentionally actuate one or more latch system levers (which can be relatively long and have centers of mass located far from the rotation axis) and consecutively act to open the door latch. Needless to say, it is highly undesirable to have the vehicle door fling open in a crash situation, especially in a rollover.

It is known to prohibit the unintended movement of one or more release levers in a vehicle door latch due to inertial forces arising from a vehicle crash. See, for example, assignee's U.S. Publication No. 2006/0131892 by Pereverzev, which describes the use of an inertia lever actuated by a counterweight in a crash situation when the inertial forces exceed a threshold level. However, one of the limitations of that system is that the counterweight is actuated only by inertial forces acting along a relatively narrow angular range.

It is desirable to have a vehicular door latch system with a safety device that prohibits movement of a latch opening part when it moves that faster than a threshold speed indicative of a crash situation. In particular, it is desirable to prohibit such movement irrespective of the direction of inertial forces acting upon the latch system. And it is most desirable to have such a door latch safety system that operates in a crash situation, but not in a typical, daily encountered, door slam situation.

SUMMARY OF THE INVENTION

Generally speaking, the invention employs a motion restriction device coupled to an opening part of a vehicle door latch that prohibits movement of the opening part faster than a threshold speed. The motion restriction devices utilizes a velocity dependent material or shear thickening fluid that stiffens considerably when the material or fluid is subject to high shear rates.

In a preferred embodiment, the motion restriction device is coupled to an auxiliary pawl that is connected to the pawl of a ratchet and pawl combination. The auxiliary pawl must be actuated by one or more release levers in order to actuate the pawl and release the ratchet from a striker-containing position and open the latch. By coupling the motion restriction device to a lever located close to the pawl, it is possible to target release motion that originates from a variety of sources within the latch system. In addition, because the only criterion for selectively prohibiting movement of the auxiliary pawl is its speed, it is possible to prevent the latch from unintentionally opening regardless of the direction the inertial forces are applied to door handles, latch or the release levers therein.

In the preferred embodiment there is a lost motion or one way connection between the auxiliary pawl and pawl such that when the vehicle door is slammed and the pawl pivots in reaction to the ratchet, the pawl does not engage and actuate the auxiliary pawl. The lost motion or one way connection thus decouples the pawl from the motion restriction device in a door slam situation, but not a door crash situation where release levers are likely to act on the auxiliary pawl.

In the preferred embodiment, the auxiliary pawl is coupled to the motion restriction in such a manner that the angular speed of the auxiliary pawl is amplified when applied to the motion restriction device, to increase the speed of a moveable part of the motion restriction device.

Thus, one aspect of the invention relates to a vehicle door latch having a housing; a ratchet mounted for pivotal movement in the housing, the ratchet moving between a latched position for retaining a striker and an unlatched position for releasing the striker, the ratchet being biased toward the unlatched position; a pawl mounted for pivotal movement in the housing, the pawl moving between an engaged position maintaining the ratchet in the latched position and a release position enabling the ratchet to move into the unlatched position, the pawl being biased (e.g., with a spring) toward the engaged position; an auxiliary pawl moveably mounted in the housing between an initial position and a release position in which the pawl is actuated into its release position; at least one release lever moveably mounted in the housing for actuating the auxiliary pawl into its release position; and a motion restriction device including a moveable part arranged for movement through a velocity dependent material that substantially inhibits motion of the moveable part when its speed exceeds a threshold speed, wherein the auxiliary pawl is connected to the moveable part of the motion restriction device.

The auxiliary pawl preferably has a one way connection with the pawl such that movement of the pawl out of its engaged position and in the direction of its release position as a result of a reaction with the ratchet does not move the auxiliary pawl. The auxiliary pawl and pawl preferably have a common axis of rotation. And the one way connection may be provided by a coupling pin disposed on one of the pawl and the auxiliary pawl and slot disposed in the other of the pawl and the auxiliary pawl, the coupling pin riding in the slot. Alternatively, the one way connection can be provided by the auxiliary pawl pushing a tab on the pawl, or with a tab on the auxiliary pawl pushing the pawl.

The auxiliary pawl is preferably pivotally mounted for rotation in the housing. The motion restriction device preferably includes a stator and the moveable part of the motion restriction device is preferably a rotor having a shaft mounted for rotation within the stator, the stator containing the velocity dependent material which substantially inhibits rotation of the rotor when its angular speed exceeds a threshold speed. An input arm is connected to the rotor shaft; and the auxiliary pawl is connected to the input arm.

The input arm and the auxiliary pawl preferably have different centers of rotation and are slidingly connected at a substantially common point. The sliding connection may be provided by a coupling pin disposed on one of the input arm and the auxiliary pawl and a slot disposed in the other of the input arm and the auxiliary pawl, the coupling pin riding in the slot. Alternatively, the connection can also be provided by a gear pair (e.g., a sector arm profile on the auxiliary pawl and a pinion mounted on the rotor shaft of the device). The radial distance between the common point to the rotation axis for the auxiliary pawl is preferably greater than the radial distance between the common point to the rotation axis for the input arm whereby the angular speed of the input arm is greater than the angular speed of the auxiliary pawl.

Preferably, the rotor and stator have inter-fitting annular disks or coaxial cylinders, and the velocity dependent material is present in the interstitial area.

The latch may also include an inside release lever and an outside release lever located in planes perpendicular to one another. The latch system may also include an outside handle and an inside handle.

According to another broad aspect of the invention a method is provided for preventing the opening of a vehicle door latch having at least one pivotal lever for opening the latch. The method includes: (i) providing a motion restriction device having an input shaft, wherein the motion restriction device prohibits movement of its input shaft when the angular speed thereof exceeds a threshold speed; (ii) monitoring the speed of the opening lever by coupling it to the input shaft; (iii) amplifying rotational movement of the opening lever and applying the amplified rotational movement to the input shaft whereby the angular speed of the input shaft exceeds the angular speed of the opening lever; and resisting the motion of the opening lever when its angular speed exceeds a predetermined angular speed.

BRIEF DESCRIPTION OF THE DRAWINGS

Exemplary embodiments of the invention will be readily appreciated as the same becomes better understood by reference to the following detailed description when considered in connection with the accompanying drawings wherein.

DETAILED DESCRIPTION OF PREFERRED EMBODIMENTS

Figure 1:
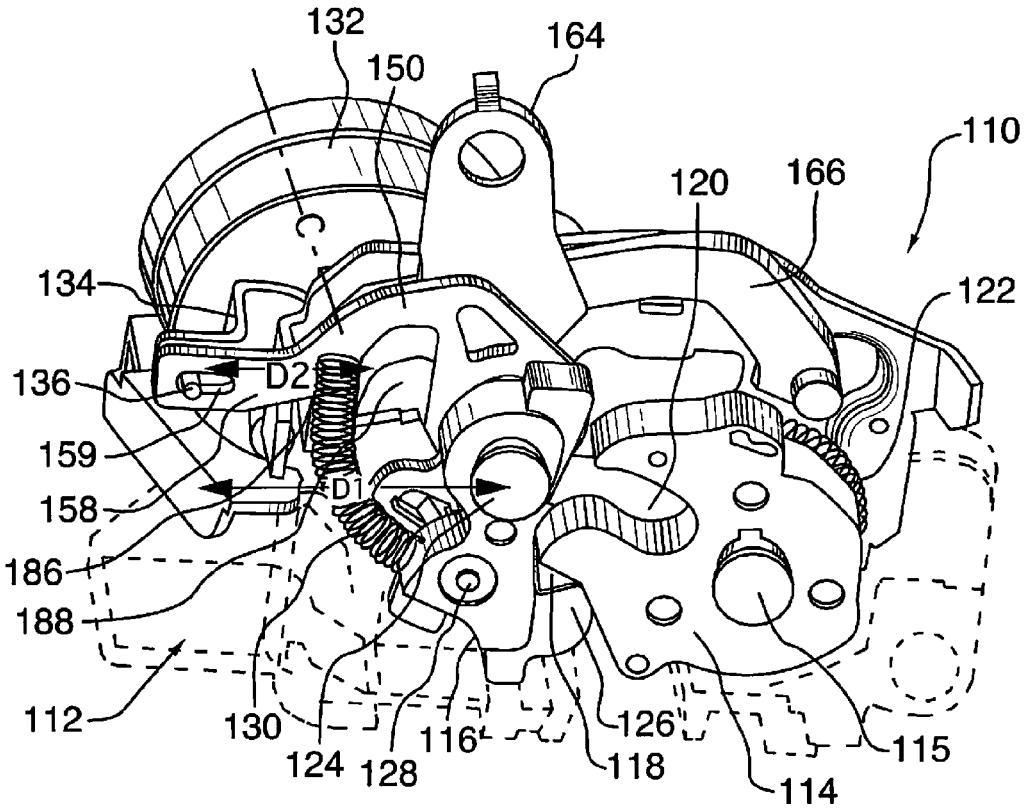
FIG. 1 is a perspective view of a door latch assembly including a pawl maintaining a ratchet in a latched position.
Figure 2:
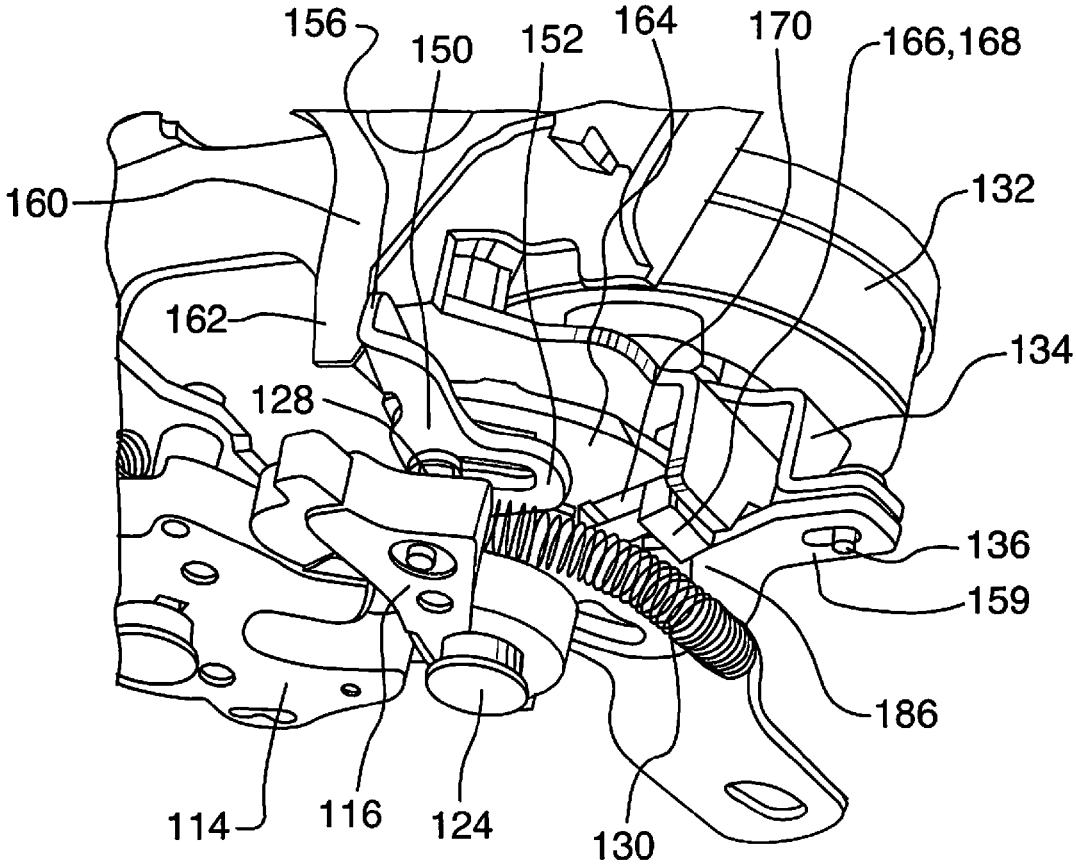
FIG. 2 is a fragmentary perspective view of the door latch assembly shown in FIG. 1, taken from a somewhat different viewpoint.
Figure 3:
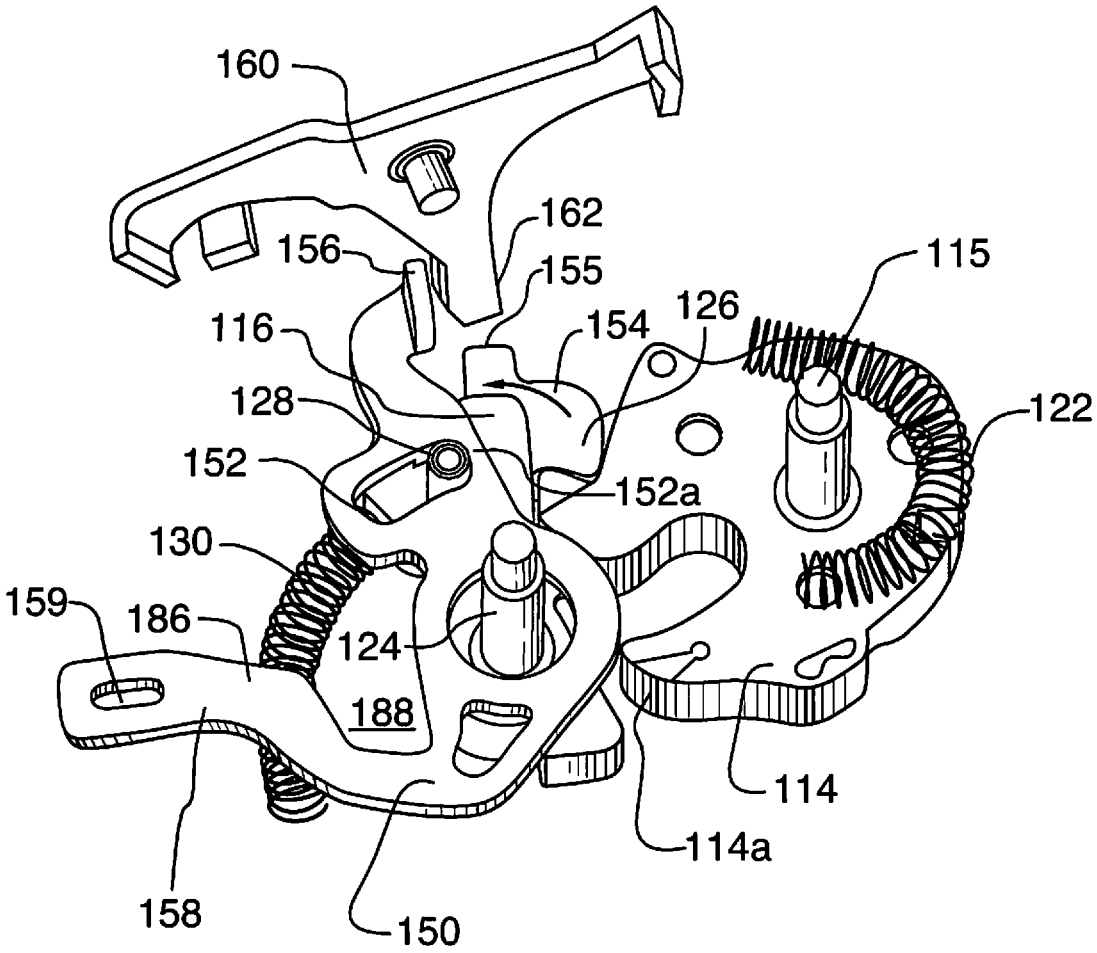
FIG. 3 is another fragmentary perspective view of the door latch assembly shown in FIG. 1, taken from a different viewpoint.

Referring to FIGS. 1 through 3, a door latch assembly, generally shown at 110, includes a housing 112 (shown in phantom as the details thereof are not important to understanding the invention) adapted to be attached to a motor vehicle door. The motor vehicle door may be, but is not limited to, a side door, a liftgate, a hood, a decklid, a sliding door, or a cargo door.

A first member or ratchet 114 and a second member or pawl 116 each are rotatably mounted to the housing 112. The ratchet 114 includes a shoulder 118 and defines an opening 120. The ratchet 114 is movable between a latched position, shown in FIG. 1, in which a striker (not shown) positioned along a motor vehicle body is retained within the opening 120 to lock the motor vehicle door and an unlatched position in which the striker is released from the ratchet 114 to allow opening of the motor vehicle door. The ratchet pivots about pin 115 and a spring 122 biases the ratchet 114 towards the unlatched position.

The pawl 116 is rotatable about a pin 124. The pawl 116 includes a retention portion 126. When the pawl 116 is in a pawl engagement position, shown in FIG. 1, the retention portion 126 engages the shoulder 118 to maintain the ratchet 114 in the latched position. When the pawl 116 is moved out of the pawl engagement position, the ratchet 114 is free to move from the latched position to the unlatched position. A spring 130 biases the pawl 116 towards the pawl engagement position.

The door latch assembly 110 includes a motion restriction device, generally indicated at 132, positioned along the housing 112. The motion restriction device 132 selectively prevents or blocks movement of the pawl 116 out of the pawl engagement position, depending on the angular or rotational speed of the pawl 116. (As discussed in greater detail below, the speed of an auxiliary pawl is directly monitored rather than the speed of the pawl, but the speed of the pawl is related to the speed of the auxiliary pawl.) In the embodiment described herein, the motion restriction device 132 does not operate to block the pawl 116 if its high speed motion is caused as a reaction to fast movement of the ratchet 114 from the unlatched to latched position due to the motor vehicle door being slammed shut. However, the motion restriction device 132 will function to substantially resist movement of the pawl 116 out of the pawl engagement position in a crash situation that causes the pawl to pivot at an angular or rotational speed above a threshold value.

More particularly, the pawl 116 is actuated or moved out of the pawl engagement position into its release position by an auxiliary pawl 150 that is connected to the motion restriction device as discussed in greater detail below. The auxiliary pawl 150 is mounted for pivotal or rotational movement about pin 124, thus having the same center of rotation as the pawl 116. The auxiliary pawl 150 is moveable between a rest position coincident with the engaged position of the pawl 116 as shown in the drawings and a release position coincident with the pawl release position. In the illustrated embodiment the pawl spring 130 also biases the auxiliary pawl 150, but if desired separate biasing springs may be provided for these components.

As seen best in FIG. 3 the pawl 116 and auxiliary pawl 150 are coupled via a one way or lost motion connection comprising a coupling pin 128 fixedly secured or integrated with the pawl 116 that travels in a slot 152 of the auxiliary pawl 150. When the motor vehicle door is slammed, the ratchet 114 moves from its unlatched to its latched position and pivots about pin 115 in a counterclockwise direction (with reference to FIG. 3, which shows the ratchet in the latched position). In the process, a leading shoulder 114*a* of the ratchet 114 interacts with portion 126 of the pawl 116, pushing it so as to pivot in the counterclockwise direction as indicated by arrow 154. The one way or lost motion connection, including the size and relative locations of the pin 128 and slot 152, is configured to ensure that the rotation of the pawl 116 as a result of a slam will not engage and actuate the auxiliary pawl 115 which, in FIG. 3, would otherwise cause the auxiliary pawl 150 to rotate counterclockwise and possibly be affected by the motion restriction device 132. In particular, the slot 152 is long enough to accommodate the maximum allowable rotational travel of the pawl 116, which is limited by biasing spring 130 and a hard stop (not shown) on the housing interacting with protrusion 155 of the pawl.

However, the independent pivotal movement of the auxiliary pawl 150 in the counterclockwise direction into its release position does affect and move the pawl 116 counterclockwise to its release position because, in the biased position of the pawl 116 as shown in FIG. 3, the pawl coupling pin 128 abuts an edge 152*a* of the auxiliary pawl slot 152 and thus pin 128 will be dragged along when the auxiliary pawl 150 pivots counterclockwise.

The auxiliary pawl 150 may be actuated into its release position by one or more other levers, depending on the design of the latch in question.

In the illustrated embodiment, the latch is based on the latch described in Assignee's U.S. Pat. No. 7,264,283, the contents of which are incorporated herein by reference in their entirety. In this latch, an inside release lever 160 (FIGS. 2 and 3—hidden from view in FIG. 1) features a leg 162 for engaging a raised tab 156 of the auxiliary pawl 150 in order to actuate it into its release position. Also, an outside release lever 164 (shown only in FIGS. 1 and 2) may be utilized to actuate the auxiliary pawl 150 into its release position. In the illustrated embodiment, as explained more fully in U.S. Pat. No. 7,264,283, the outside release lever 164 is selectively connected to the auxiliary pawl 150 by means of a slidable link 166 (shown only partially in FIGS. 1 and 2) that has a depending tab 168 (FIG. 2) that slides in and along a slot 170 disposed in the outside release lever 164. The tab 168 slides between a first position, near the open end of the slot 170, and a second position, near the closed end of the slot 170. When the tab 168 is located in the first position adjacent the open end of the slot 170, rotation of the outside release lever 164 causes the tab 168 to engage an abutment 186 of the auxiliary pawl 150 (as seen in FIG. 2) and thus cause it, and correspondingly pawl 116, to rotate. However, when the tab 168 is located in the second position adjacent the closed end of the slot 170, the tab 168 is positioned in a void 188 (seen best in FIGS. 1 and 3) of auxiliary pawl 150 whereby rotation of the outside release lever 164 is not coupled to the auxiliary pawl 150. The slidable link 166 is controlled ultimately by an outside key cylinder (not shown) or an inside lock rod (not shown).

Note that in the illustrated latch the outside release lever 164 and inside release lever 160 are located in planes perpendicular to one another, and the inertial forces in a crash may affect any one of these release levers 160, 164.

The auxiliary pawl 150 is also coupled to the motion restriction device 132. More particularly, the auxiliary pawl 150 includes a leg 158 with a small slot 159 therein. As seen in FIGS. 1 and 2, the motion restriction device 132 has a rotatable input arm 134 with a coupling pin 136 that engages and rides in the auxiliary pawl slot 159. The arrangement and sizing of the pin 136 and slot 159 are such that pivotal movement of the auxiliary pawl 150 results in the pivotal movement of the input arm 134. The angular speed of the input arm 134 will be approximately twice the angular speed of the auxiliary pawl because the radial distance D1 between the coupler pin 136 and the auxiliary pawl center of rotation (at pin 124) is approximately twice the radial distance D2 between the coupler pin 136 and the center of rotation of the input arm 134, as indicated by axis C in FIG. 1. It should be noted, however, that this ratio could be adjusted to suit the needs of any particular latch system. The pin 136 and slot 159 thus provide a sliding connection between the auxiliary pawl 150 and input arm 134 in order to accommodate for the different centers of rotation of these components.

The motion restriction device is preferably filled with a velocity-dependent material that can be a fluid, gel, foam, or like material. The velocity-dependent material also includes solid particles. An exemplary fluid that can be used for this purpose is described in U.S. Pat. No. 7,342,049. The velocity-dependent material transitions between a fluid-like state having a low viscosity and providing only negligible or limited resistance to deformation, and a solid-like state having a high viscosity and providing considerable resistance to deformation. Whether the velocity-dependent material acts as a fluid or a solid depends upon the velocity of the member acting upon the motion restriction device. If the velocity of the member is below a predetermined threshold, such as would occur at rest or during normal operation of the latch system, the velocity-dependent material will be in a fluid-like state. On the other hand, if the velocity of the member is above a predetermined threshold, the solid particles aggregate and the velocity-dependent material will be in a solid-like state. Once the velocity of the member drops below the predetermined threshold, the velocity-dependent material transitions back to the fluid-like state. Thus, a single motion restriction device 132 with the velocity-dependent material may be utilized to permit movement of a member or component in certain situations and substantially resist the same movement in other situations.

Figure 5:
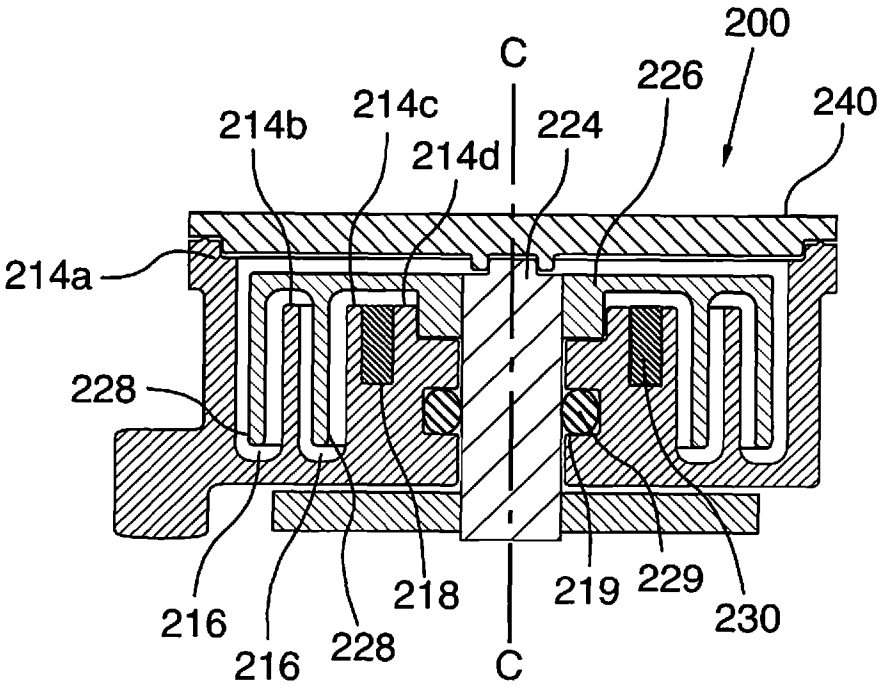
FIG. 5 is a cross-sectional view of the motion restriction device shown in FIG. 4.
Figure 4:
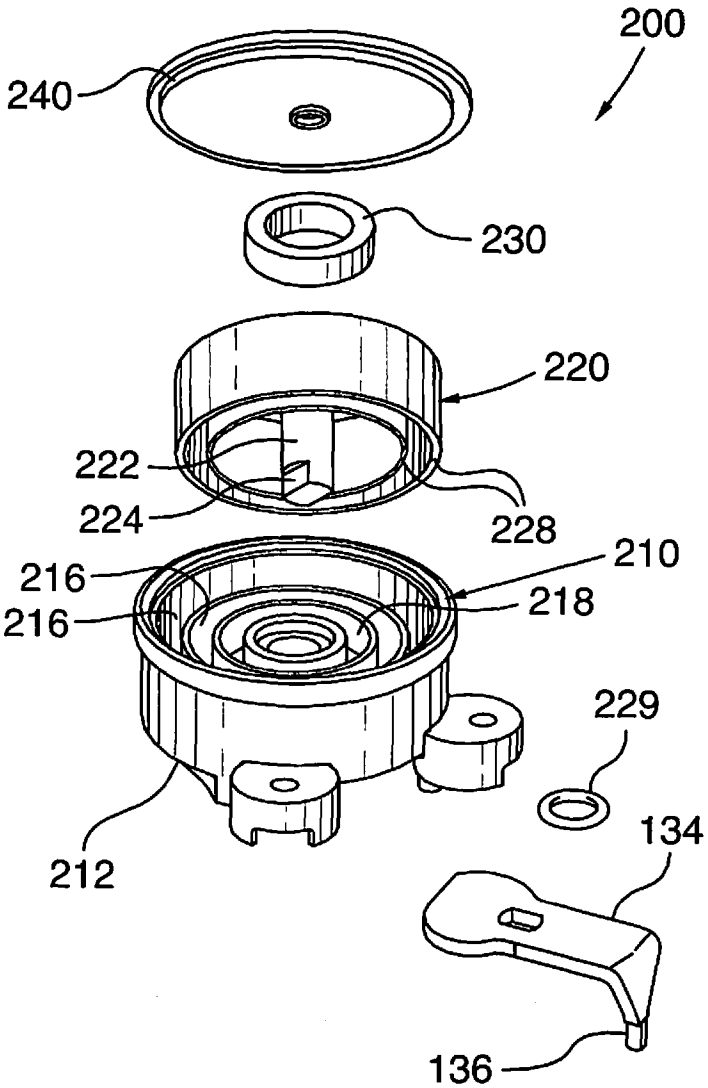
FIG. 4 is an exploded view of a first embodiment of a motion restriction device employed in the latch assembly for preventing unintended unlatching of the ratchet.

One embodiment of the motion restriction device 132 designated by reference numeral 200 is shown in FIGS. 4 and 5. The motion restriction device 200 includes a stator or housing 210, a rotor 220, a foam washer 230 and a cover 240. The housing 210 has a base 212 and features a plurality concentric circular walls 214*a*, 214*b* 214*c*, and 214*d* depending from and arranged transverse to the major plane of the base 212. Walls 214*a*, 214*b* and 214*c* form longitudinally orientated concentric outer toroidal cavities 216 about the center axis C of the device 200. Walls 214*c* and 214*d* form an inner toroidal cavity 218.

The rotor 220 includes a shaft 222 defining the central axis C of the device. The shaft 222 features a keyed end 224 for securely connecting the input arm 134 to the shaft. The opposing end of the shaft 222 is connected to or formed with a web such as a circular plate 226 from which concentric circular walls or cylindrical sleeves 228 depend transverse to the web in a longitudinal orientation relative to the central axis C of the device 300.

In assembly, the rotor cylindrical sleeves 228 are disposed in the respective toroidal cavities 216 of the housing. The rotor cylindrical sleeves 228 preferably occupy most of the volume in the housing toroidal cavities 216 resulting in a relatively thin layer of the velocity dependent material between the rotor cylindrical sleeves 228 and the housing circular walls 214*a*, 214*b*, 214*c*, resulting in a relatively high shear on the velocity dependent material. The design also maximizes the surface area available for subjecting the velocity dependent material to shear forces in a relatively small package space.

The foam washer 230 is installed in housing cavity 218 and functions as compressible resilient member to account for volumetric changes in the velocity dependent material due to temperature changes. An O-ring 229 seated in a circumferential groove 219 of the housing 210 and mounted about the shaft 224 seals the device 200 against leakage of the velocity dependent material.

Figure 6:
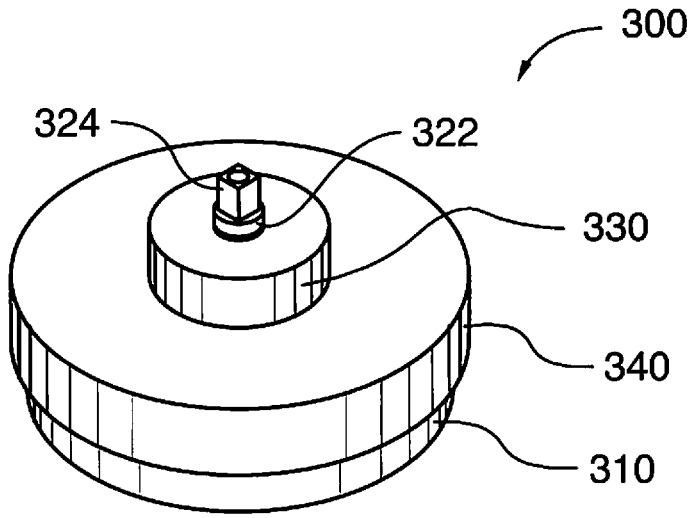
FIG. 6 is an perspective view of a second embodiment of a motion restriction device employable in the latch assembly for preventing unintended unlatching of the ratchet.
Figure 7:
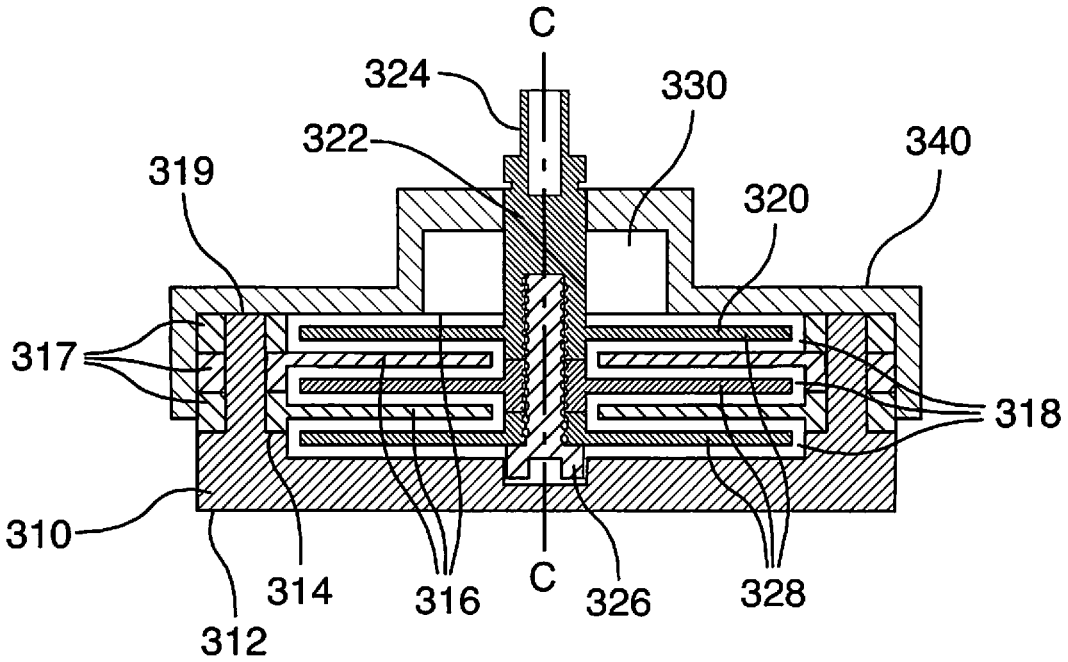
FIG. 7 is a cross-sectional view of the motion restriction device shown in FIG. 6.

Another embodiment of the motion restriction device 132 designated by reference numeral 300 is shown in FIGS. 6 and 7. The motion restriction device 300 includes a stator or housing 310, a rotor 320, and a cover 340. The housing 310 has a base 312 with a transverse sidewall 314 from which depend a plurality of circular walls 316 concentric about the center axis C of the device 300. In the illustrated embodiment, the circular walls 316 are provided in part by a plurality of stacked disks 317 interconnected by a fastener 319. The circular walls 316 form latitudinal orientated concentric shallow cylindrical cavities 318. The cavities 318, which are in fluid communication with one another, are filled with the velocity dependent material.

The rotor 320 includes a partially hollow shaft 322 defining the central axis C of the device 300. The shaft 322 features a keyed end 324 for securely connecting the input arm 134 to the shaft. The opposing end of the shaft 322 is journaled about a spindle 326 installed in the housing. A plurality of latitudinal orientated disks 328 depend from the shaft 322, each disk 328 respectively disposed in one of the shallow cylindrical cavities 318. The rotor disks 328 preferably occupy most of the volume in the shallow cylindrical cavities 318 resulting in a relatively thin layer of the velocity dependent material between the rotor disks 328 and the housing circular walls 316, resulting in a relatively high shear on the velocity dependent material. The design also maximizes the surface area available for subjecting the velocity dependent material to shear forces in a relatively small package space.

A seal 330 with a compliant or foam lower portion is installed between the rotor shaft and cover 340 to prevent leakage of the velocity dependent material and functions as compressible resilient member to account for volumetric changes in the velocity dependent material due to temperature fluctuations.

It will thus be seen that the two illustrated embodiments 200, 300 of the motion restriction device are quite similar with the orientation of the rotor cylinders and disks and corresponding stator cavities being arranged either generally parallel to the rotor shaft or generally transverse to the rotor shaft. As such, the motion restriction device can be considered to have a rotor and stator with inter-fitting coaxial cylinders or annular disks.

Figure 3A:
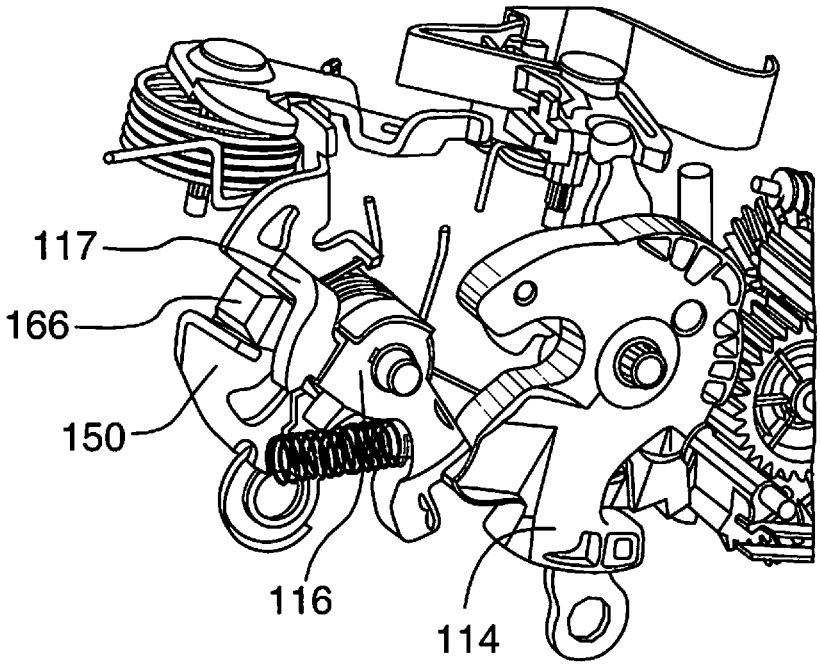
FIG. 3A is a fragmentary perspective view of a variant of the door latch assembly shown in FIG. 1.

The one way connection between the pawl and auxiliary pawl has been shown as being provided by a pin on the pawl and a slot in the auxiliary pawl. However, the reverse orientation, where the pin is disposed on the auxiliary pawl and the slot is disposed on the pawl, is also possible. Alternatively, the one way connection can be provided by the auxiliary pawl pushing a tab on the pawl, or with a tab on the auxiliary pawl pushing or pulling the pawl. In push tab embodiments, there is no slot—and no danger of contact during door slam. For instance, FIG. 3A shows a variant of the latch shown in FIG. 1 where the pawl 116 includes a tab 117 that interacts with the auxiliary pawl 150 via slidable link 166. As the movement of the pawl 116 to the release position from the engaged position (as shown) is in the clockwise direction with reference to FIG. 3A (which is in reverse orientation relative to FIG. 3), the overslam condition will also result in the pawl 116 pivoting clockwise without causing corresponding movement of the auxiliary pawl 150. However, when the auxiliary pawl 150 pivots clockwise into its release position, it also moves the pawl 116 into its release position.

Figure 3B:
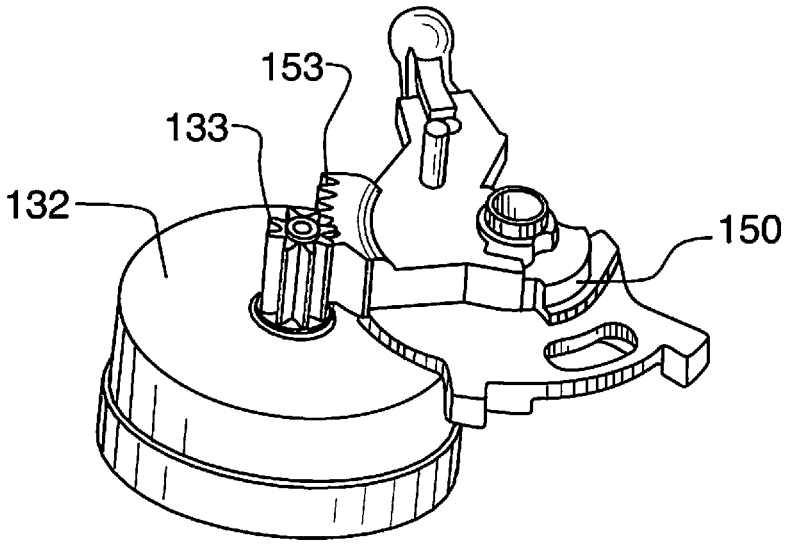
FIG. 3B is a fragmentary perspective view of another variant of the door latch assembly shown in FIG. 1.

The connection between the auxiliary pawl and the motion restriction device has been shown as a pin and slot sliding connection between these components. An alternative arrangement for coupling the auxiliary pawl to the motion restriction device could include a pair of gears as shown in FIG. 3B, preferably one formed as a sector gear on auxiliary pawl 150 and the second gear 133 mounted to the rotor shaft of the motion restriction device 132.

In alternative embodiments of the invention, one or more other operating parts of the latch can be operatively connected to the motion restriction device 132. For example, any of the inside or outside release levers may be connected to the motion restriction device via a suitably shaped input arm and suitably positioned motion restriction device. Alternatively, the motion restriction device may be placed at the outside or inside handles. Also, if door slams situations are not a concern, or if the threshold speed is set very high above what would typically be encountered in a door slam situation, the lost motion or one way connection between the pawl and auxiliary pawl may be omitted, or the pawl may itself be directly coupled to the motion restriction device.

While the above describes a particular embodiment(s) of the invention, it will be appreciated that modifications and variations may be made to the detailed embodiment(s) described herein without departing from the spirit of the invention.

The invention claimed is:

1. A vehicle door latch, comprising:

a housing;

a ratchet mounted for pivotal movement in the housing, the ratchet moving between a latched position for retaining a striker and an unlatched position for releasing the striker, the ratchet being biased toward the unlatched position;

a pawl mounted for pivotal movement in the housing, the pawl moving between an engaged position maintaining the ratchet in the latched position and a release position enabling the ratchet to move into the unlatched position, the pawl being biased toward the engaged position;

an auxiliary pawl moveably mounted in the housing between an initial position and a release position in which the pawl is actuated into the release position for the pawl, wherein the auxiliary pawl has a one way connection with the pawl such that movement of the pawl out of the engaged position for the pawl and in the direction of the release position for the pawl as a result of a reaction with the ratchet does not move the auxiliary pawl;

at least one release lever moveably mounted in the housing for actuating the auxiliary pawl into the release position for the auxiliary pawl;

a motion restriction device including a moveable part arranged for movement through a velocity dependent material that substantially prevents motion of the moveable part therethrough when a speed of the moveable part exceeds a threshold speed and permits motion of the moveable part therethrough when the speed of the moveable part is below the threshold speed, wherein the auxiliary pawl is connected to the moveable part of the motion restriction device and is pivotally mounted for rotation in the housing; and the motion restriction device includes a stator and the moveable part of the motion restriction device includes a rotor having a shaft mounted for rotation within the stator, the stator containing the velocity dependent material which substantially inhibits rotation of the rotor when an angular speed of the rotor exceeds the threshold speed, an input arm is connected to the rotor shaft and the auxiliary pawl is connected to the input arm;

wherein the input arm and the auxiliary pawl have different centers of rotation and are slidingly connected at a substantially common point.

2. A latch according to claim 1, wherein the one way connection is provided by a coupling pin disposed on one of the pawl and the auxiliary pawl and a slot disposed in the other of the pawl and the auxiliary pawl, the coupling pin riding in the slot.

3. A latch according to claim 1, wherein the one way connection is provided by a tab on either of the pawl or the auxiliary pawl wherein the tab only moves the pawl when the auxiliary pawl rotates.

4. A latch according to claim 1, wherein the sliding connection is provided by a coupling pin disposed on one of the input arm and the auxiliary pawl and a slot disposed in the other of the input arm and the auxiliary pawl, the coupling pin riding in the slot.

5. A latch according to claim 1, wherein the sliding connection is provided by a geared connection between the auxiliary pawl and the input arm.

6. A latch according to claim 1, wherein a radial distance between the common point to the center of rotation for the auxiliary pawl is greater than a radial distance between the common point to the center of rotation for the input arm whereby an angular speed of the input arm is greater than an angular speed of the auxiliary pawl.

7. A latch according to claim 1, wherein the rotor and stator have inter-fitting annular disks or coaxial cylinders, and the velocity dependent material is present in an interstitial area between the inter-fitting annular disks or coaxial cylinders.

8. A latch according to claim 1, wherein said at least one release lever includes an inside release lever and an outside release lever each located in planes perpendicular to one another.

* * * * *